US005125131A

United States Patent [19]

Leblanc

[11] Patent Number: 5,125,131

[45] Date of Patent: Jun. 30, 1992

[54] HINGE LOCKING MECHANISM WITH DISENGAGE ACTION

[75] Inventor: Joseph E. Leblanc, Reseda, Calif.

[73] Assignee: Hughes Aircraft Company, Los Angeles, Calif.

[21] Appl. No.: 640,748

[22] Filed: Jan. 14, 1991

[51] Int. Cl.[5] ..... E05D 11/10

[52] U.S. Cl. ..... 16/330; 16/329

[58] Field of Search ..... 16/329, 330

[56] References Cited

U.S. PATENT DOCUMENTS 872,650 12/1907 Gilroy ..... 16/330

4,999,937 3/1991 Bechtold ..... 16/329

FOREIGN PATENT DOCUMENTS 232741 4/1925 United Kingdom ..... 16/330

*Primary Examiner*—Robert L. Spruill

*Assistant Examiner*—Carmine Cuda

*Attorney, Agent, or Firm*—R. M. Heald; C. D. Brown; W. K. Denson-Low

[57] ABSTRACT

A locking hinge mechanism (10) that includes a hinge (10*a*) comprising an articulated axle (28) rotatably attached to first and second members (22,24) such that the operation of the hinge mechanism (10*a*) causes the members (22,24 ) to controllably move in a first or opening direction and a second or closing direction. The hinge (10*a*) comprises a fixed locking member (36), and a movable locking member (46) coaxially disposed relative to the fixed locking member (36). A bias mechanism (48) is coupled to the movable locking member (46) that causes it to interlockably engage the fixed locking member (b 36) such that the hinge (10*a*) causes the first and second members (22, 24) to freely move in one direction. A disengagement mechanism (38, 40) is coupled to the movable locking member (46) to disengage it from the fixed locking member (36) so that the first and second members (22, 24) may freely move in either direction. The hinge mechanism (10) also comprises control apparatus (34, 54) coupled to the disengagement mechanism (38, 40) which permits the first and second members (22, 24) to move in a closing direction when the locking members (36, 46) are disengaged. Furthermore, a control system (52) may be coupled to the hinge mechanism (10) that is adapted to control the deployment and retraction of the first and second members (22, 24).

4 Claims, 3 Drawing Sheets

Fig. 1a.
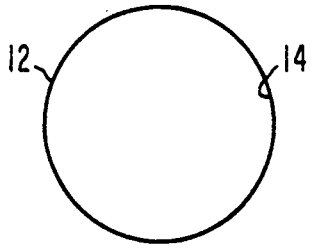
Fig. 1b.
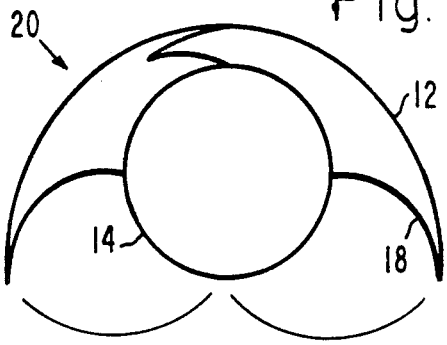
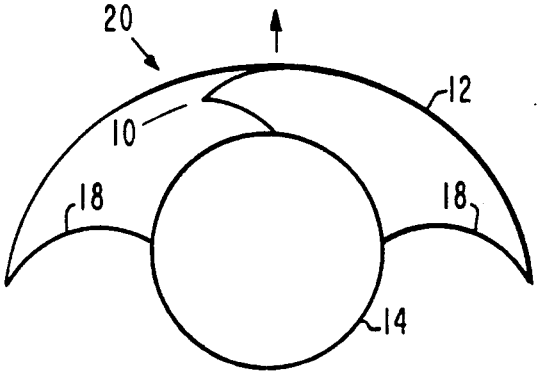
Fig. 1c.
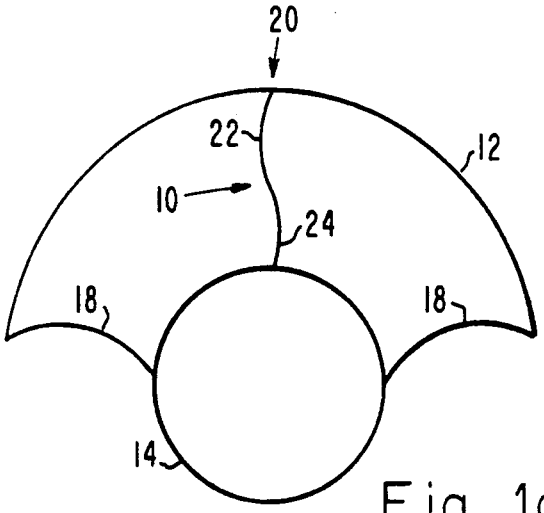
Fig. 1d.
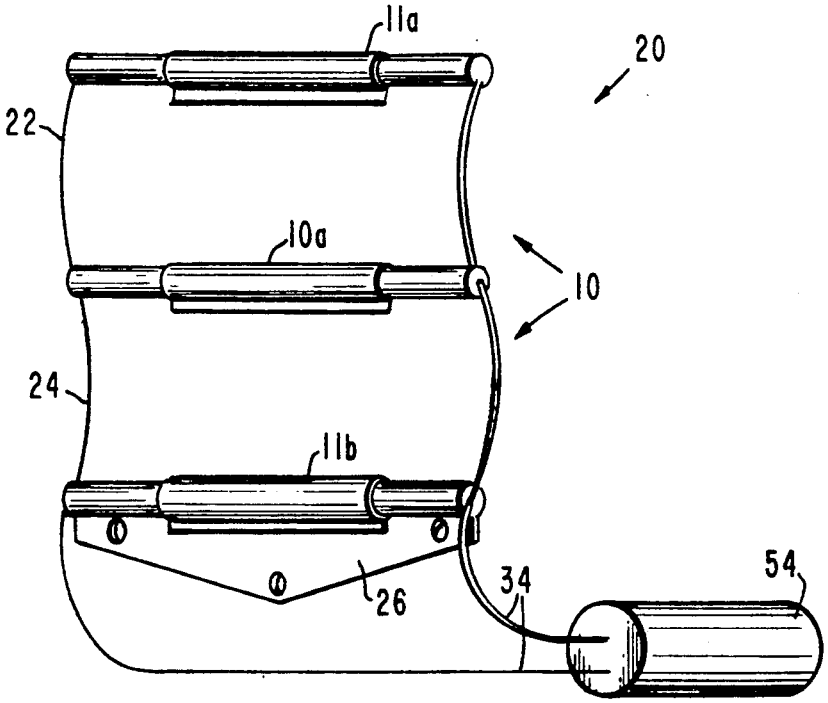
Fig. 2.

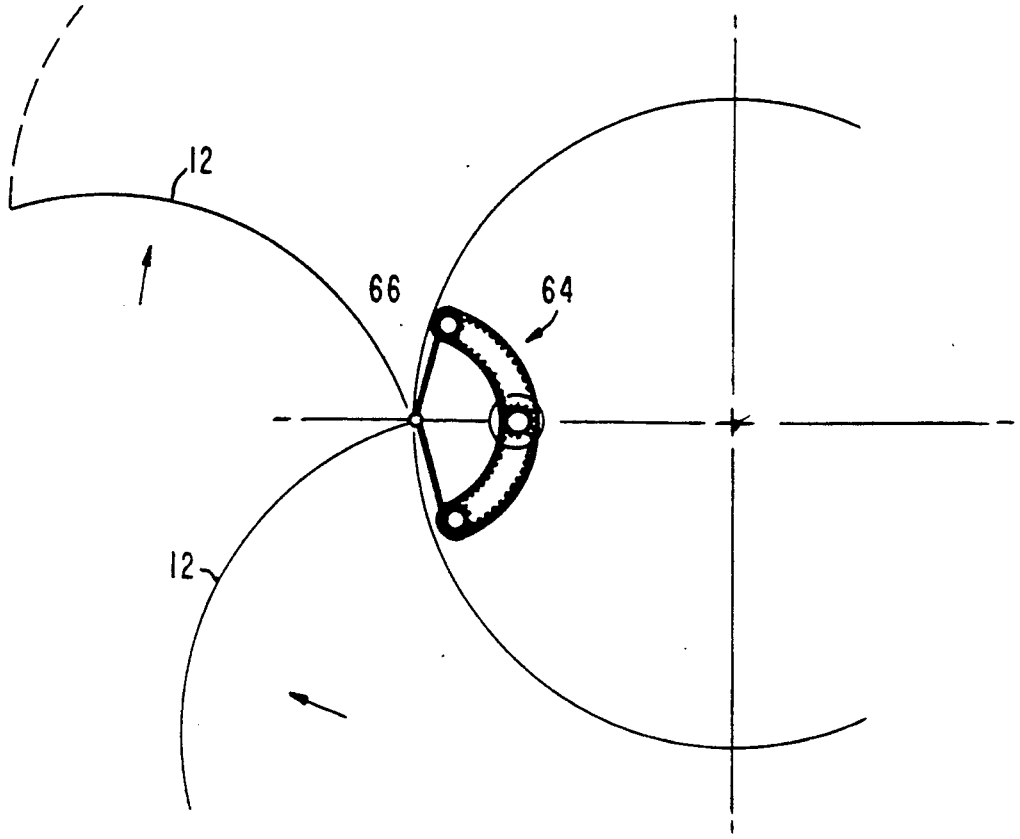
Fig. 4b.
Fig. 4c.
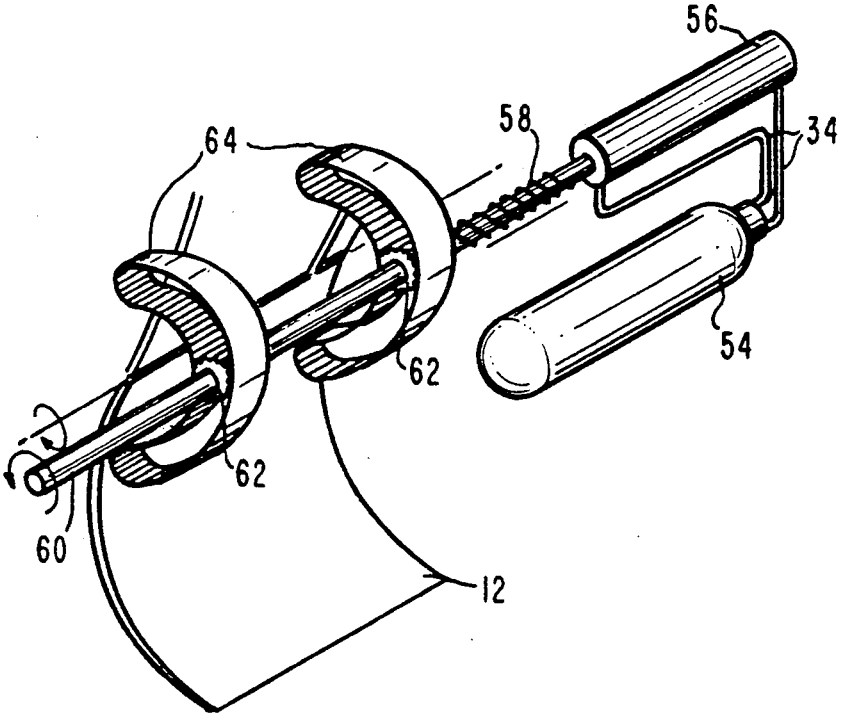

HINGE LOCKING MECHANISM WITH DISENGAGE ACTION

The present invention generally relates to hinges and particularly to locking hinge mechanisms employed to allow the controllable deployment and retraction of components attached thereto.

There are a number of mechanical situations where locking hinges are used as part of a system used to deploy an operating member and lock it in a deployed position until it is positively released, whereafter it is partially or fully retracted. One such system employs the use of wing-like components or ring wings that are used with various types of missiles to improve their maneuverability during part of their flight. Such wing-like components require special hinge locks that allow the wing to open, but prevent it from collapsing. Once the ring wing is open, the locks insure the rigidity of the structure under considerable tress. The ring wing is adapted to fit tightly against the missile body during launch after which is then erected, thus enabling the missile to make tight, banked turns in much the same manner as an airplane. The extract shape of the wing is a function of the extended support members or struts which unfold outwardly from the missile body once the wing is activated.

Previously designed ring wing mechanisms for use on a guided missile used a ratchet-type hinge lock to prevent the collapse of the wing after it opened, but since the wing was not designed to be retracted, it only had a one-way extension motion. Furthermore, the final shape of this wing could not be readily modified, once it was fully deployed. Since the relative motions of the target and the missile may necessitate that the wing shape be changed, and even retracted, as the hunt and pursuit patterns change, it would be very desirable to be able to do this on command either from the launch vessel, or from an internal on-board steering system.

SUMMARY OF THE INVENTION

The present invention is a hinge locking mechanism comprising an articulated axle rotatably attached to first and second members such that the operation of the hinge mechanism causes the members to move in a first or opening direction and a second or closing direction. The hinge mechanism comprises a fixed locking member, and a movable locking member that is coaxially disposed relative to the fixed locking member. Bias means are provided that causes the movable locking member to interlockably engage the fixed locking member such that the hinge mechanism causes the attached first and second members to freely move in one direction but not in a reverse direction. Disengagement means are provided for causing the movable locking member to disengage from the locking member so that the hinged members may freely move in either direction.

The locking hinge mechanism is disengaged by means of a controlled application of mechanism, hydraulic or pneumatic pressure applied to at least one end point or the center of the locked hinge mechanism. This pressure serves to disengage the hinge locking mechanism so that the position of the hinged components are controllably closed. When the pressure is relived, the locking mechanism automatically reengages the lock the hinge mechanism in the new position.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIGS. 1*a* to 1*d* illustrate the sequence by which a wing-like component surrounding a cylindrical base is deployed into its final position and locked therein;

FIG. 2 is a vertical front view of the center strut used to support and lock the wing-like component of FIG. 1 in the extended position;

FIGS. 4*a* to 4*c* show an exemplary mechanism for causing the wing-like component to extend and retract.

DETAILED DESCRIPTION

Figure 3A:
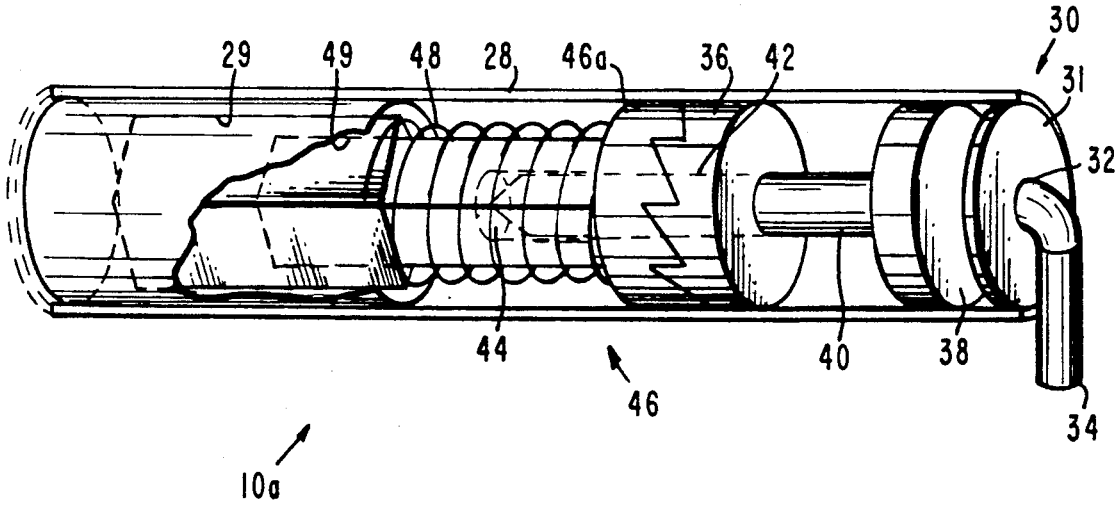
FIGS. 3*a* and 3*b* are enlarged partial cross-sectional views of the hinge locking device of the present invention in the engaged and disengaged positions.

FIG. 1 is an exemplary illustration of the basic sequence in which a hinge locking mechanism 10 of the present invention is used in connection with the deployment of a wing-like component 12 (or ring wing 12) from a restrained, retracted position (FIG. 1*a*) against the outer surface a cylindrical base 14. When it is desired to deploy the wing-like component 12, wing restraints (not shown) are released and the ring wing 12 is free to move, through the action of biased struts 18 (or wing supports) attached to ends thereof (FIGS. 1*b* and 1*c*), to reach the final extended position, shown in FIG. 1*d*. The final operational position and shape of the ring wing 12 is basically governed by the action of a hinged center support 2 which works in conjunction with the biased struts 18, through the action of a control system (shown in more detail in FIG. 4), the nature of which will be further explained herein below.

As shown in FIG. 2, the center support 20 comprises an upper strut or panel 22, the uppermost portion of which is attached to the underside of the ring wing 12 by a first hinge 11*a*, and a lower strut or panel 24, the lowermost portion which is attached, through a second hinge 11*b* and a mounting plate 26 to the body of the cylindrical base 14. Connecting the upper and lower panels 22,24 is a locking hinge 10*a*. As shown in FIG. 2, the locking hinge 10*a* is disposed within an articulated axle attached to the upper and lower struts 22,24 of the center support 20 so as to allow the ring wing 12, once extended, to form and maintain the shape of a fixed-wing-like truss.

It is recognized that there may be times when it is desirable either to be able to change the shape of the deployed ring wing 12, or to retract it. In order for the shape of the ring wing 12 to be varied, or for the ring wing 12 to be retracted, the locking hinge 10*a* must be controllably disengaged to allow such a reversed motion and then reengaged to lock the ring wing 12 into this new position. This is accomplished in the embodiment of FIG. 2 by means of a hydraulic or pneumatic pump drive 54, for example, coupled to the hinge locking mechanism 10 by means of a plurality of hydraulic or pneumatic pressure line 34, for example.

Figure 3B:
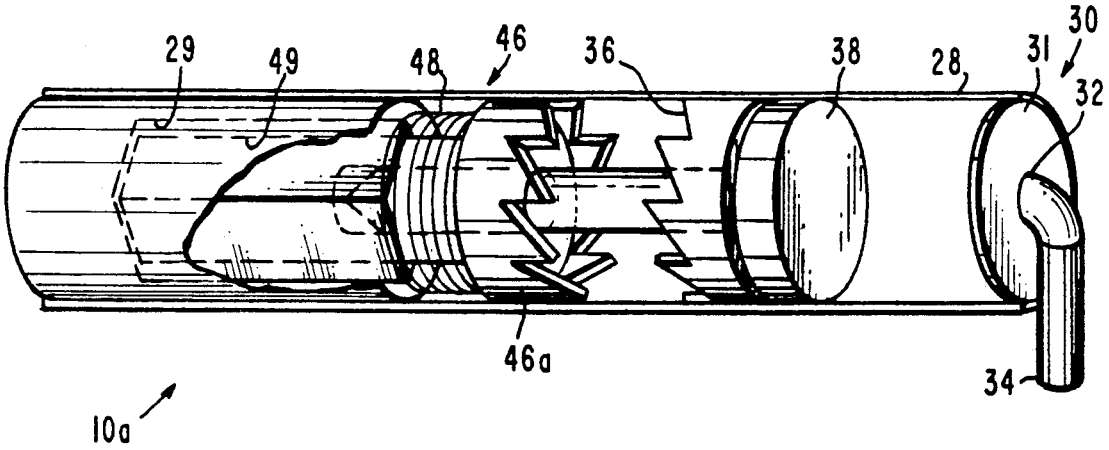

FIGS. 3*a* and 3*b* show a preferred embodiment of an exemplary locking hinge 10*a* of the present invention in a normal, first in an engaged position (FIG. 3*a*) and then in a disengaged position (FIG. 3*b*). As illustrated in FIG. 3*b*, the locking hinge 10*a* is disposed within a portion of the center axle 28 having a partially hollowed out end cap 30 attached thereto. One end of the center axle 28 has a square shaped cavity 29 disposed therein that is adapted to mate with a correspondingly shaped portion of one of two locking members or ratchets as will be described below.

The end cap 30 comprises a hollow cylinder, closed on one end by an end plate 31 that contains a hole 32 to allow the connection thereto of a pressurized hydraulic or pneumatic pressure line 34 of a release mechanism comprising the hydraulic or pneumatic pump drive 54. The end plate 31 fits on the extreme end of the center axle 28. The axle 28 has a segment of reduced diameter that accepts the end cap 30. The end cap 30 has a fixed locking member which is shown in the form of a fixed ratchet 36 circumferentially attached to the inside surface thereof some distance away from the interior surface of end plate 31. Between the inside of the end plate 31 and the fixed ratchet 36, a piston head 38 has an extension rod 40 attached thereto that fits into and passes through hole 42 in the center of the fixed ratchet 36 to penetrate into a cavity 44 within a movable locking ember or ratchet block 46. The piston head 38 is adapted to move freely back and forth within the space between the fixed ratchet 36 and the end plate 31. The movable ratchet block 46 is slideable within the square cavity 29 of the center axle 28, but is normally interlocked with an held firmly in contact with the fixed ratchet 36 by biasing means shown as a biasing spring 48. In general the square shaped cavity 29 may have any noncircular cross section that is adapted to prevent the movable locking member or ratchet block 46 from rotating with respect to the center axle 28, but allows a linear displacement for disengaging from the fixed ratchet 36.

It is to be understood that numerous types of biasing means maybe used in conjunction with the present invention, and the biasing means may be any force directing device such as a compressed spring or a hydraulic or pneumatically controlled solenoid and that the two locking members may be in the form of hydraulically, electrically or mechanically controlled clutches or any other mechanical system, for example. The movable ratchet block 46 is comprised of a movable ratchet **46*a* and a square piston 49 which fits into and slides within the square cavity 29, thus coupling the center axle 28 to the fixed ratchet 36**.

In the normal locked position, which is shown in FIG. **3*a*, the force exerted by the biasing spring 48 keeps the fixed and movable ratchets 46*a*, 36 firmly in contact thus locking the locking hinge 10*a*. The ratchet teeth are arranged in a way to allow the hinged structure to open, but not to close. When the locking hinge 10*a* is to be released, a force is applied to the piston head 38 by means of the pressure line 34. This in turn causes the piston rod 40 to move inward with the end of the rod 40 impinging against the bottom of the cavity 44. When sufficient force has been generated to overcome the closing force exerted by the biasing spring 48, the movable ratchet 46*a* moves away from the fixed ratchet 36 with the result that the center axle 28 is now free to move to a new position. When the pressure is relieved, the biasing spring 48 causes the movable ratchet 46*a* to reengage the fixed ratchet 36, thus restraining further movement of the locking hinge 10*a***.

Figure 4A:
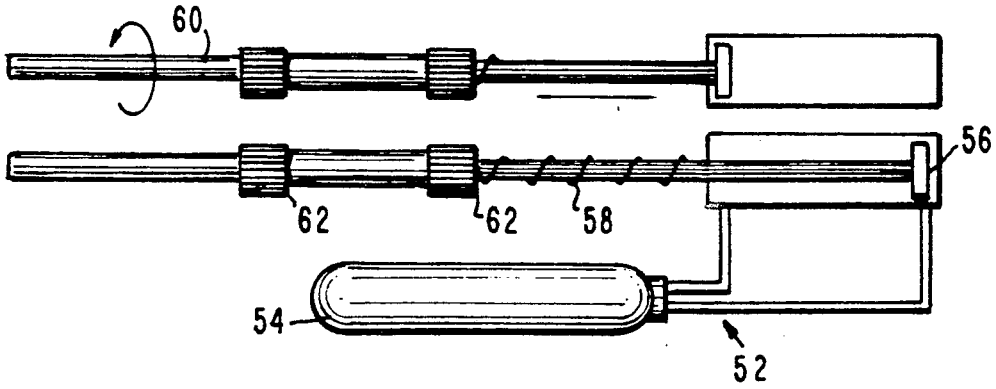

It will be appreciated that once the ratchets 36, **46*a* are disengaged natural forces such as wind or water currents encountered during use may serve to present the reefing the outer ring wing sail 16 to a new retraced position and that an auxiliary system may be necessary to accomplish this change. An exemplary control system for achieving and positively controlling the extent of the above described wing deployment or retraction is illustrated in FIGS. 4*a* to 4*c*. Shown in FIG. 4*a*, is an exemplary hydraulic drive system 52 which is used to perform such deployment and retraction. This system 52 comprises a hydraulic pump drive 54 that is operatively connected to an internal piston 56 of a "Yankee screwdriver" drive 58. This screwdriver 58 converts the linear motion of the hydraulic drive 54 to a rotational motion in either a clockwise or counter-clockwise direction, depending on which side of internal piston 56, the hydraulic fluid is admitted. An output shaft 60 of the screwdriver drive 58 is connected to a gear 62 retained within a hollow cam housing 64 having a lever arm 66 attached thereto (FIG. 4*b*). As the shaft 60 turns, the rotation of the gear 62 causes the hollow cm 64 to rotate, the rotation acting to cause the lever arm 66 to extend or retract the components of wing-like component 12 (FIG. 4*c*). While opening of the wing-like component 12 is facilitated by the spring-like nature of the wing sail 16, this motion is constrained from being too rapid by the drive mechanism 52. To protect the wing-like component 12** from the potentially corrosive air and water environments to which it may be exposed, it is preferred that the surfaces be plated either with zinc or cadmium and then painted with either a polyurethane or epoxy-based paint.

While FIGS. **3*a* and 3*b* show an exaggerated axial dimension of the locking hinge 10*a* of the present invention, for clarity of demonstration the locking hinge 10*a* may be made very compact, if desired. Further, while the position of the locking hinge 10*a* and the arrangement of the locks is shown at one end of the hinge axis, the locking hinge 10*a* maybe located anywhere along the hinge axis. When located at the end points, a symmetrical arrangement with locks located at both ends of the case 28 is most effective. When located at the center portion of the hinge, the pressure line 34** penetrates into the cap through the cylindrical wall of the hinge.

The disengaging feature disclosed herein can also be applied to a wide variety of other instances and operating systems wherein a hinge must freely move in only one direction, while being positively prevented from moving in the opposite direction until it is controllably released to allow for free movement in either direction. The force that actuates the disengaging mechanism can be by the application of hydraulic, pneumatic, electromagnetic or mechanical energy thereto, thus allowing a variety of applications from heavy machinery to small mechanical gadgets, and can be used as a safety device to prevent collapse in case of failure from other mechanical parts. In such applications, it is understood that the bias means may be any force directing device such as a compressed spring or a hydraulic or pneumatically controlled solenoid and that the two locking members may be in the form of hydraulically, electrically or mechanically controlled clutches or any other mechanical system adapted to operate in the manner described herein above without departing from the scope of the present invention.

Thus there has been described a new and improved hinge locking mechanism comprising a locking hinge and control apparatus therefor. It is to be understood that the above-described embodiment is merely illustrative of some of the many specific embodiments which represent applications of the principles of the present invention. Clearly, numerous other arrangements can be readily devised by those skilled in the art without departing from the scope of the invention and all of these embodiments are considered to be embraced herein.

What is claimed is:

1. A rotatable hinge mechanism attached to first and second members wherein controlled rotation of the hinge in a first direction causes the first and second members to move away from one another and controlled rotation of the hinge in a second, opposite direction causes the first and second members to move toward one another, comprising:

a hollow sleeve including a closed end portion;

a non-rotatable locking member fixedly positioned within and attached to said hollow sleeve and a coaxially disposed movable locking member slideably and rotatably positioned within said hollow sleeve, said fixed and movable locking members having interlocking ratchet teeth;

bias means for sliding the movable locking member toward the fixed locking member until the ratchet teeth interlock, whereby the movable locking member is constrained to rotate only in the first direction resulting in the first and second members moving away from one another;

release means mounted within the hollow sleeve for selectively separating the movable locking member away from the fixedly positioned locking member to disengage the interlocked teeth;

said release means comprising a piston positioned within the closed end portion of the hollow sleeve having an attached rod extending through an opening in the fixedly positioned locking member and into abutment with the movable locking member, and said release means further comprising a source of pressurized fluid in fluid communication with the closed end portion of the hollow sleeve, whereby pressurized fluid entering the closed end portion drives the piston toward the fixed locking member with the attached rod engaging and sliding the movable locking member until the interlocked ratchet teeth disengage and the movable locking member is free to rotate in either direction.

2. The hinge mechanism of claim 1, further including control means coupled to the release means for controlling the rate of movement of the first and second members toward one another upon disengagement of the interlocked teeth.

3. The hinge mechanism of claim 1, wherein said bias means comprises a spring member compressed between an end portion of the hollow sleeve and the movable locking member.

4. The hinge mechanism of claim 1, wherein the movable locking member includes an end portion of non-circular cross-section extending into a similarly shaped cavity formed in an axle attached to the first member, whereby movement of the first member causes rotation of the attached axle and movable locking member only in the first direction when the ratchet teeth of the movable and fixed locking members are interlocked.

* * * * *